United States Patent [19]

Zaremba

[11] Patent Number: 4,530,313

[45] Date of Patent: Jul. 23, 1985

[54] DRIVE ARRANGEMENT OF AN AUXILIARY DEVICE IN AN INTERNAL COMBUSTION ENGINE

[75] Inventor: Dieter Zaremba, Mühlacker, Fed. Rep. of Germany

[73] Assignee: Dr. Ing. h.c.F. Porsche Aktiengesellschaft, Stuttgart, Fed. Rep. of Germany

[21] Appl. No.: 627,560

[22] Filed: Jul. 3, 1984

[30] Foreign Application Priority Data

Jul. 6, 1983 [DE] Fed. Rep. of Germany ..... 3324327

[51] Int. Cl.[3] ..... F01P 5/12

[52] U.S. Cl. ..... 123/41.47; 123/195 A; 123/198 C

[58] Field of Search ..... 123/41.47, 41.44, 195 A, 123/198 C, 198 R

[56] References Cited

U.S. PATENT DOCUMENTS

| | | | |
|---|---|---|---|
| 1,645,188 | 10/1927 | Edwards | 123/41.44 |
| 2,068,536 | 1/1937 | Davies | 123/41.47 |
| 2,085,810 | 7/1937 | Ljungstrom | 123/41.44 |
| 2,376,939 | 5/1945 | Ricart | 123/41.46 |
| 2,631,575 | 3/1953 | Little | 123/41.47 |
| 3,003,484 | 10/1961 | Rohrbacher et al. | 123/41.47 |
| 3,498,272 | 3/1970 | Roper | 123/195 A |
| 3,728,995 | 4/1973 | Schramm | 123/195 A |
| 4,198,935 | 4/1980 | Seibt et al. | 123/41.44 |

FOREIGN PATENT DOCUMENTS

| | | | |
|---|---|---|---|
| 33787 | 5/1956 | Fed. Rep. of Germany | 123/41.44 |

*Primary Examiner*—Ira S. Lazarus

*Attorney, Agent, or Firm*—Barnes & Thornburg

[57] ABSTRACT

An auxiliary device, for example a water pump, is arranged on a housing wall of an internal combustion engine in such a way that the device is mountable in a simple manner. For this purpose, a drive gear with a pin transversely penetrating a drive shaft is tightened, from one side, and the pump wheel, attached in the drive shaft by means of a screw, is tightened from the other side against the inner race of a ball bearing, the outer race of which is fixed in the housing wall of the internal combustion engine.

11 Claims, 3 Drawing Figures

FIG. 1
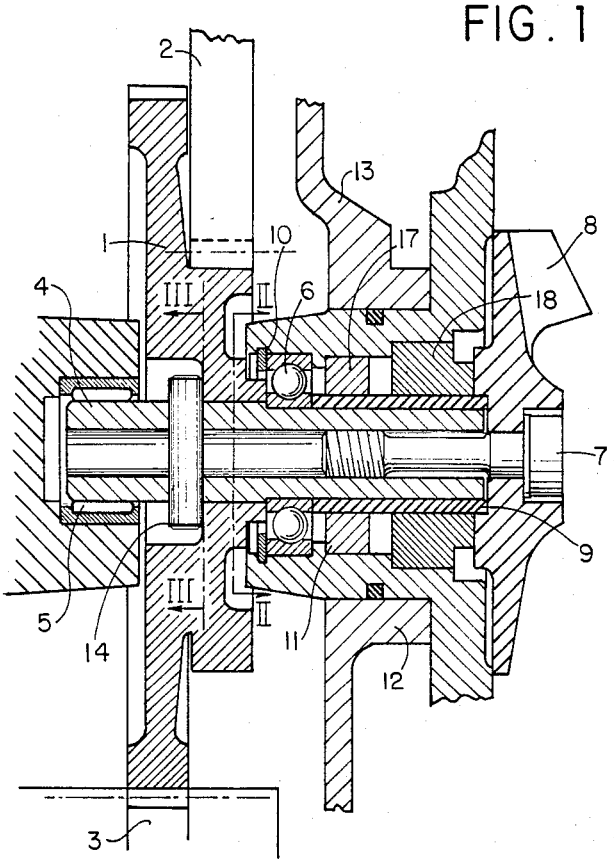
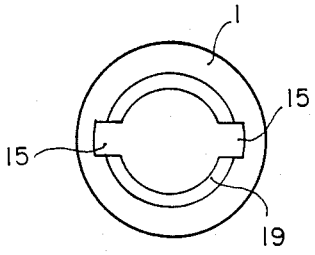
FIG.2
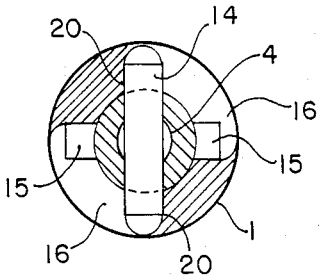
FIG.3

DRIVE ARRANGEMENT OF AN AUXILIARY DEVICE IN AN INTERNAL COMBUSTION ENGINE

BACKGROUND AND SUMMARY OF INVENTION

The invention relates to a drive arrangement of an auxiliary device, especially a water pump, on a housing wall of an internal combustion engine.

In a drive installation known from U.S. Pat. No. 3,728,995 for the oil pump of an internal combustion engine, a drive gear is keyed onto a drive shaft and, on the other side, a gear wheel of a geared oil pump is likewise mounted by means of a fitting key. In order to ensure exactly true rotation, very tight manufacturing tolerances must be maintained in this construction. If the oil pump is to be dismounted for repair purposes, screws must be released on both sides of the drive shaft, which is very difficult in many installation types, and both gear wheels must be pulled off their wedged-on connections.

An object of the invention resides in constructing a drive arrangement and bearing installation of an auxiliary device, for example a water pump, in such a way that less stringent manufacturing tolerances are permissible and a simple dismounting of the pump is made possible without requiring simultaneous disassembly of the drive wheel. This latter requirement is posed, above all, if the water pump is suspended on the drive train of crankshaft-camshaft, for in this case, due to the disassembly of the drive wheel, the relative position of the camshaft with respect to the crankshaft would be altered and would have to be readjusted.

In accordance with the present invention, in an internal combustion engine having a housing wall, an auxiliary device mounted on the housing wall, and a drive wheel positioned on a first side of the housing wall, a drive arrangement for driving the auxiliary device is provided. The drive arrangement comprises a driven wheel positioned on a second side of the housing wall and a drive shaft supported by the housing wall. The driving wheel and driven wheel are mounted and centered on the drive shaft. A lug means is positioned on the first side of the housing wall for drivingly connecting the drive wheel to the drive shaft. A threaded connector means is positioned on the second side of the housing wall for securing the drive shaft to the driven wheel.

Preferably a stop at the drive shaft and a threaded connection are employed to tighten the drive wheel from one side, the pump wheel, with interposition of a sleeve centered on the drive shaft, from the other side against the inner race of a ball bearing. The outer race of the ball bearing is fixed either directly in a housing wall of an internal combustion engine or in the one housing half of the water pump flanged to the housing wall.

Such a drive arrangement and bearing installation makes it possible to utilize a pin transversely penetrating the drive shaft as the stop at the drive shaft. The pin is extensible through two longitudinal grooves of the drive wheel and, after twisting in the range of annular-segment recesses at the end face, is fixable in the circumferential direction as well as axially on the end face of the drive wheel. Accordingly, for mounting the pump wheel, the entire drive connection of crankshaft-camshaft can remain unchanged. The assembly can be effected quickly and reliable. The present invention obviates the need for the use of tight-tolerance, expensive fittings during the manufacture of the connecting parts.

Further objects, features, and advantages of the present invention will become more apparent from the following description when taken with the accompanying drawings which show, for purposes of illustration only, embodiments in accordance with the present invention.

BRIEF DESCRIPTION OF THE DRAWINGS

FIG. 1 is a longitudinal section of a water pump drive mechanism of an internal combustion engine constructed in accordance with a preferred embodiment of the invention;

FIG. 2 is a sectional view of the drive (shaft) gear hub of the present invention taken along line II—II of FIG. 1, FIG. 3 is a sectional view of the drive shaft and drive gear hub of the present invention taken along line III—III of FIG. 1.

DETAILED DESCRIPTION OF THE DRAWINGS

A driving wheel such as drive gear 1 is centered on a hollow drive shaft 4, meshes with a gear wheel 2 and a gear wheel 3 and serves as an intermediate gear of the crankshaft-camshaft drive connection. The drive shaft 4 is supported at its end in a needle bearing 5, and at its center in a ball bearing 6. An auxiliary device, such as a water pump, includes a driven wheel such as pump wheel 8. Pump wheel 8 is threadably connected to the other end of the drive shaft 4 with a centrally positioned threaded connector such as screw 7. The pump wheel 8 is centered on a sleeve 9. Sleeve 9 in turn, is slidably fit onto the drive shaft 4. The outer race of the ball bearing 6 is fixed between an expansion ring 10 and a lug or protrusion 11 in one housing half 12 of the water pump. The housing half 12 is centered in the housing wall 13 of the internal combustion engine and is flanged connected thereto.

In order to mount the pump wheel 8 of the water pump, the drive shaft 4, with the lug means, such as pin 14, extending transversely therethrough, is first pushed through the centering bore 19 of drive gear 1, provided with longitudinal grooves 15, and one end of the drive shaft 4 is inserted in the needle bearing 5. The drive shaft 4 is then rotated 90° over the zone of the annular-segment recesses 16 until the pin 14 comes into contact with the stop surfaces 20 and is secured in the circumferential direction. The recesses 16 and stop surfaces 20 are formed on the axially inwardly facing end face of drive wheel 1. The pin 14 includes two end portions projecting radially out of the shaft 4. The end portions have milled faces for providing a broad area defined contact with the end face of the drive wheel 1. The ball bearing 6 and the sealing rings 17 and 18 are preassembled in the housing half 12. The sleeve 9 is inserted until it abuts the seat or inner race ball bearing 6. The preassembled housing half 12 is pushed over the drive shaft 4 and flanged to the housing wall 13 of the internal combustion engine. The pump wheel 8 is centered on the sleeve 9 and threadably clamped to the drive shaft 4 by means of the screw 7. By tightening the screw 7, the drive gear 1 is simultaneously tensioned by way of the pin 14 and tightened against the inner race of the ball bearing 6. In this way, the complete assembly is held together, the power train being effective along the shortest route.

Although the invention has been described in detail with reference to certain preferred embodiments and specific examples, variations and modifications exist within the scope and spirit of the invention as described and as defined in the following claims.

What is claimed is:

1. In an internal combustion engine having a housing wall, an auxiliary device mounted on the housing wall, and a drive wheel positioned on a first side of the housing wall, a drive arrangement for driving the auxiliary device comprising a driven wheel positioned on a second side of the housing wall, a drive shaft supported by the housing wall, and on which the drive wheel and driven wheel are mounted and centered, a lug means positioned on the first side of the housing wall for drivingly connecting the drive wheel to the drive shaft and a threaded connector means positioned on the second side of the housing wall for securing the drive shaft to the driven wheel.

2. The drive arrangement of claim 1 further comprising a ball bearing means having an outer race radially and axially fixed with respect to said housing wall of the internal combustion engine, and an inner racè, and a sleeve means centered on the drive shaft, and extending between the inner race and the driven wheel, wherein said threaded connector means is tightenable from the second side of the housing wall to engage the lug means of the drive shaft with the drive wheel.

3. The drive arrangement of claim 2 further comprising sealing rings wherein said auxiliary device comprises a water pump having a housing half, the water pump housing half including means for being flange-mounted and centered on an end face of the housing wall of the internal combustion engine, the sealing rings and ball bearing being centered and mounted in the first water pump housing half.

4. The drive arrangement of claim 2 wherein said lug means comprises a pin extending transversly through said drive shaft, the pin being in contact with an end face of the drive wheel.

5. The drive arrangement of claim 2 wherein the drive wheel includes a centering bore having two diametrically opposed continuous longitudinal grooves, and an end face having two annular-segment recesses and stop surfaces, the centering bore, longitudinal grooves, annular-segment recesses, and stop surfaces being configured to permit the lug means of the shaft to be extended through the longitudinal grooves, be rotated over the zone of the annular-segment recesses and fixed in place in a circumferential direction by the stop surfaces.

6. The drive arrangement of claim 5 wherein said lug means comprises a pin extending transversely through the shaft.

7. The drive arrangement of claim 5 wherein the annular-segment recesses extend over an angular range of 90°.

8. The drive arrangement of claim 1 wherein said lug means comprises a pin extending transversely through said drive shaft, the pin being in contact with an end face of the drive wheel.

9. The drive arrangement of claim 8 wherein said pin includes two end portions projecting out of the shaft, the end portions having milled faces for providing a broad area defined contact with the drive wheel.

10. The drive arrangement of claim 9 wherein said threaded connector means comprises a screw, said drive shaft is hollow-drilled and includes a central threaded portion, and said driven wheel comprises a water pump wheel which is attached to the shaft by the screw which threadedly engages the central threaded portion of the drive shaft.

11. The drive arrangement of claim 1 wherein said threaded connector means comprises a screw, said drive shaft is hollow-drilled and includes a central threaded portion, and said driven wheel comprises a water pump wheel which is attached to the shaft by the screw which threadedly engages the central threaded portion of the drive shaft.

* * * * *